US007436368B1

(12) United States Patent
Snodgrass

(10) Patent No.: US 7,436,368 B1
(45) Date of Patent: Oct. 14, 2008

(54) ANTENNA ADAPTER FOR IMPROVED COSITE PERFORMANCE

(75) Inventor: Timothy E. Snodgrass, Palo, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 34 days.

(21) Appl. No.: 11/229,417

(22) Filed: Sep. 16, 2005

(51) Int. Cl.
*H01Q 1/32* (2006.01)

(52) U.S. Cl. ..... 343/715; 343/713

(58) Field of Classification Search ..... 343/715, 343/702, 711, 712, 713
See application file for complete search history.

(56) References Cited

U.S. PATENT DOCUMENTS 4,825,217 A * 4/1989 Choi ..... 343/715
5,252,985 A * 10/1993 Christinsin ..... 343/880
5,515,064 A * 5/1996 Bacnik et al. ..... 343/860
5,541,615 A * 7/1996 Koide et al. ..... 343/858
6,256,480 B1 * 7/2001 Stengel, Jr. ..... 455/78
6,404,396 B1 * 6/2002 Hung et al. ..... 343/749

OTHER PUBLICATIONS

JTRS Challenges, printed from website www.sdri.com on Aug. 6, 2007, 15 pages.

* cited by examiner

*Primary Examiner*—Tho G Phan
(74) *Attorney, Agent, or Firm*—Nathan O. Jensen

(57) ABSTRACT

An antenna for a military ground vehicle having a radio includes a whip element and a base plate attached to the whip element. The base plate has a first set of dimensions. The antenna also includes an antenna adapter that is attached to the base plate. The antenna adapter has a housing having a second set of dimensions and a filter circuit coupled to the whip element and the radio. The filter circuit is configured to tune the frequency of the antenna. Alternatively, the filter circuit may be disposed within an antenna mount used to mount the antenna to a vehicle.

13 Claims, 5 Drawing Sheets

ANTENNA ADAPTER FOR IMPROVED COSITE PERFORMANCE

FIELD OF THE INVENTION

The present invention relates generally to the field of antennas for military vehicles and in particular, to an antenna adapter for an antenna of a military vehicle having a radio used as a node in a wireless communication network.

BACKGROUND OF THE INVENTION

Wireless communication networks may be used for numerous applications including tactical military and commercial applications. In an exemplary application, military vehicles (e.g., tanks, trucks, airplanes, etc.) may include radios that act as nodes in the wireless communication network. One type of radio is a software defined radio (SDR). A software defined radio may be implemented in existing radios and the existing physical enclosures of these radios (i.e., the legacy radio form factors). In order to receives and transmit signals, vehicle radios are coupled to an antenna or antennas. Mobile military ground vehicles (e.g., tucks, tanks, etc.) may utilize an untuned whip antenna.

There are several problems that may be encountered by using untuned whip antennas on military ground vehicles. When two vehicles are near each other, RF coupling between the whip antennas limits the communication range because of co-located interference (or cosite interference) and forces frequency management to keep transmissions approximately 10% of the frequency apart from reception frequencies. For example, when two ground vehicles, vehicle A and vehicle B, are next to each other, the antennas are in parallel and a large amount of power from vehicle A may be absorbed by vehicle B which distorts the messages/signals received and/or transmitted by vehicle A. Interference, e.g., cosite interference, is also a problem between two dedicated whip antennas on the same vehicle. Previous solutions have involved the addition of, for example, large filters, RF cancellers, high IP3 (Intermodulation Performance of the $3^{rd}$ Order) receivers or all three in to the radio/transceiver. All of these solutions, however, consumes precious volume inside a radio's form factor (e.g., the physical shape and size of the radio) which may limit how much cosite performance may be obtained. Cosite performance may be limited by the amount of volume available in the radio form factor.

Accordingly, there is a need for an antenna adapter configured to improve cosite performance of an antenna on a military ground vehicle. There is also a need for an antenna adapter which may be used to retrofit existing military ground vehicle antennas.

It would be desirable to provide a system and/or method that provides one or more of these or other advantageous features. Other features and advantages will be made apparent from the present specification. The teachings disclosed extend to these embodiments which fall within the scope of the appended claims, regardless of whether they accomplish one or more of the aforementioned needs.

SUMMARY OF THE INVENTION

In accordance with an embodiment, an antenna for a military ground vehicle having a radio includes a whip element, a base plate attached to the whip element and having a first set of dimensions, and an antenna adapter attached to the base plate and including a housing having a second set of dimensions and a filter circuit electrically coupled to the whip element and the radio, the filter circuit configured to tune the frequency of the antenna.

In accordance with an another embodiment, an antenna adapter for an antenna of a military ground vehicle having a radio includes a housing having a first set of dimensions and a filter circuit disposed within the housing and electrically coupled to the antenna and the radio, the filter circuit configured to tune the frequency of the antenna.

In accordance with another embodiment, an antenna for a military ground vehicle having a radio includes a whip element, a mount attached to the whip element, the mount having a volume defined by a set of dimensions and a filter circuit disposed within the mount volume and electrically coupled to the whip element and the radio, the filter circuit configured to tune the frequency of the antenna.

BRIEF DESCRIPTION OF THE DRAWINGS

The invention will be more readily understood by reference to the following description taken with the accompanying drawings, in which.

DETAILED DESCRIPTION OF THE PREFERRED EMBODIMENTS

Figure 1:
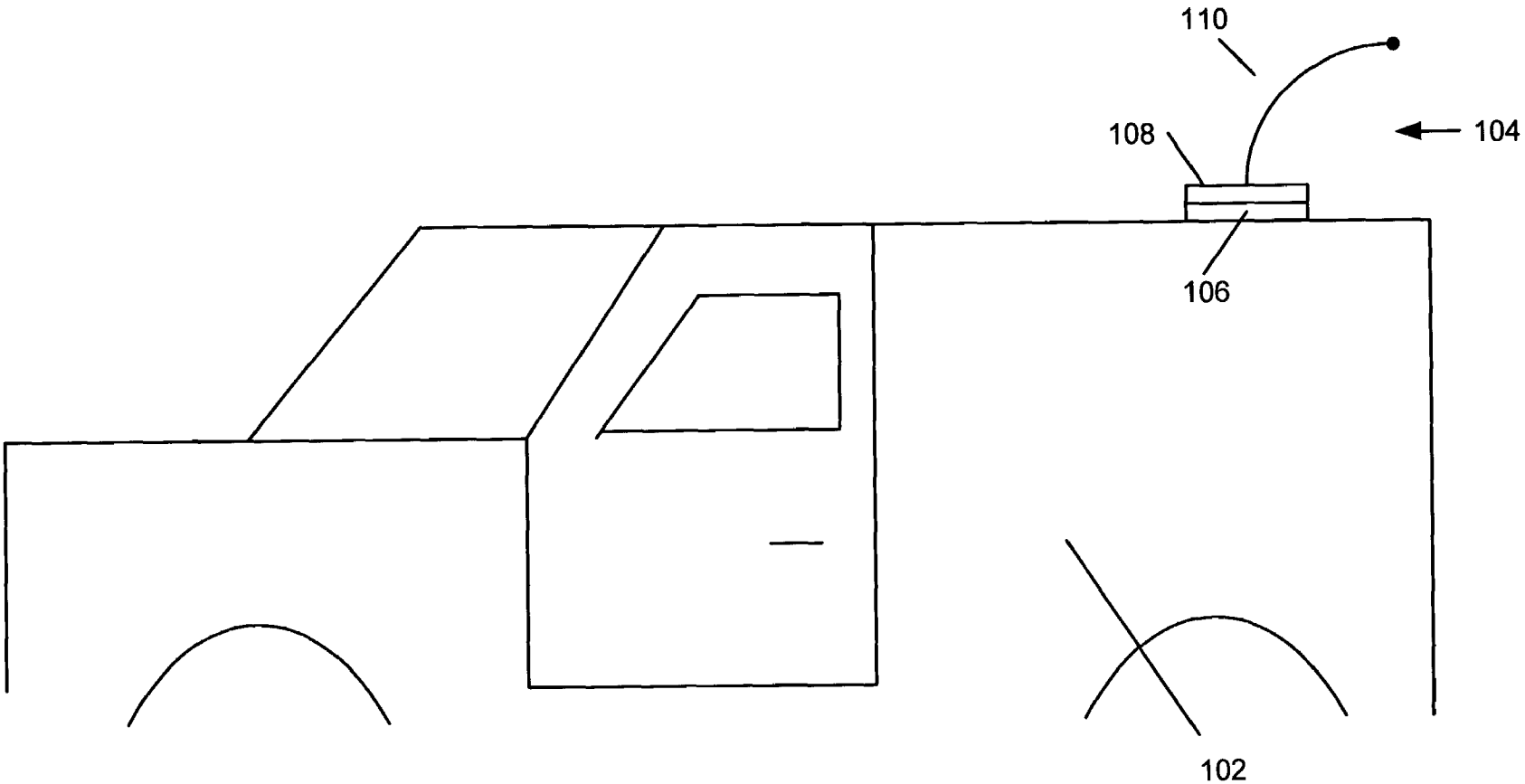
FIG. 1 is a is a perspective view of a vehicle with an antenna and an antenna adapter in accordance with an embodiment.

Before describing in detail the particular improved system and method, it should be observed that the present invention includes, but is not limited to a novel structural combination of conventional data/signal processing components and communications circuits, and not in the particular detailed configurations thereof. Accordingly, the structure, methods, functions, control and arrangement of conventional components and circuits have, for the most part, been illustrated in the drawings by readily understandable block representations and schematic diagrams, in order not to obscure the disclosure with structural details which will be readily apparent to those skilled in the art, having the benefit of the description herein. Further, the present invention is not limited to the particular embodiments depicted in the exemplary diagrams, but should be construed in accordance with the language in the claims.

FIG. 1 is a perspective view of a vehicle with an antenna and an antenna adapter in accordance with an embodiment. Vehicle 102 is a military ground vehicle such as a tank, truck, Bradley fighting vehicle, field support vehicle (e.g., ambulance, food service kitchens, supply and munitions vehicles), Tactical Operation Centers (e.g., collections of Command and Control communications vehicles), etc. Antenna 104 is mounted to vehicle 102 using conventional means such as bolts, screws, etc. Antenna 104 is a whip antenna and includes a whip element 110, a base plate 108 and an antenna adapter 106. Electrical elements of antenna 102 are coupled to a radio (not shown) in vehicle 102. Antenna 104 is used to receive signals which are provided to the vehicle radio and to transmit signals from the vehicle radio. In an alternative embodiment, vehicle 102 may include more than one antenna 104 having an antenna adapter.

The radio (not shown) of vehicle 102 may act as a node in a wireless communication network. Accordingly, vehicle 102 may communicate with other vehicles (or nodes) in the wireless network via the radio and antenna 104. The wireless communication network may be, for example, a Joint Tactical Radio System (JTRS) or other ad hoc wireless network. The radio (i.e., node) of vehicle 102 may be configured to communicate in an ad hoc wireless manner using a structured wireless channel access scheme such as Time division Multiple Access (TDMA) or a multi-channel TDMA format such as Orthogonal domain Multiple Access (ODMA).

Figure 2A:
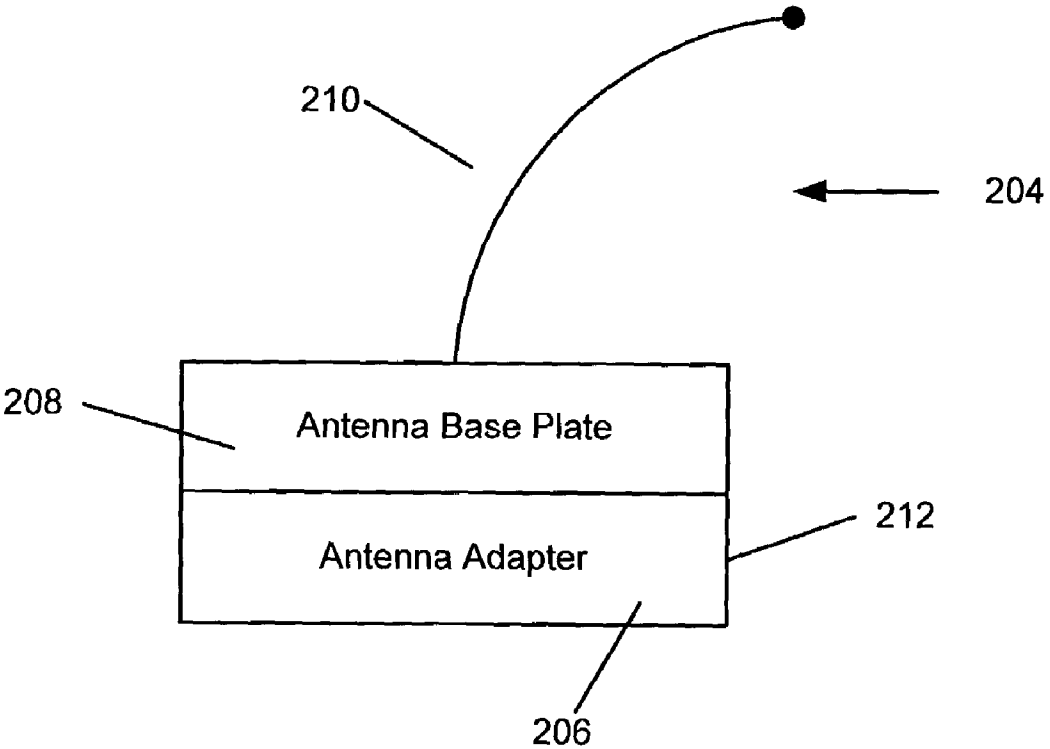
FIG. 2A is a schematic block diagram of an antenna with an antenna adapter in accordance with an embodiment.

FIG. 2A is a perspective view of an antenna and an antenna adapter in accordance with an embodiment. Antenna 204 includes a whip element 210 and a base plate 208. Whip element 210 may be formed of a metal material, such as stainless steel, coiled spring steel, wire wound fiberglass rods, base and center loaded whips. Base plate 208 is also made of a metal material and has a set of dimensions (e.g., height, width, depth, radius, etc.). For example, base plate 208 may be a three dimensional square, rectangle, circle, etc.

Figure 2B:
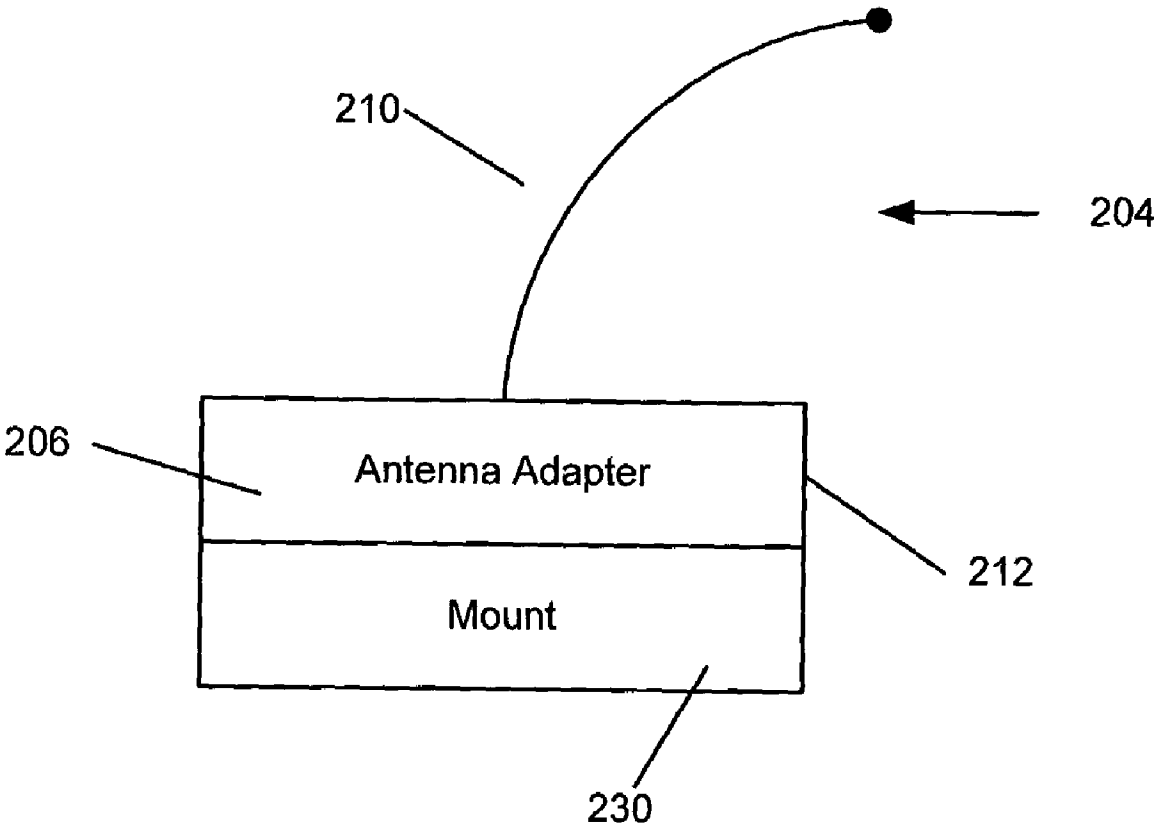
FIG. 2B is a schematic block diagram of an antenna with an antenna adapter in accordance with an alternative embodiment.

Antenna adapter 206 includes a housing 212 that is formed in the same shape as the base plate 208. In one embodiment, housing 212 may have the same dimensions as base plate 208. In an alternative embodiment, housing 212 may have at least one dimension which is different from base plate 208, for example, housing 212 may have a different height than base plate 208. Antenna adapter 206 is mounted to the vehicle (shown in FIG. 1) beneath the base plate 208. Accordingly, antenna adapter 206 is placed between the base plate 208 and the vehicle. Antenna adapted 206 is attached to the base plate 208 using conventional means. Antenna adapter 206 may be mounted to the vehicle using, for example, screws, bolts, etc. Preferably, housing 212 is formed of a metal material. In an alternative embodiment, shown in FIG. 2B, antenna adapter 206 may be placed on top of an antenna mount 230 between the mount 230 and the antenna.

Returning to FIG. 2A, housing 212 of antenna adapter 206 has a volume, defined by its dimensions. Within this volume, antenna adapter 206 includes a tunable filter circuit (not shown) as well as other appropriate circuitry (not shown) that is used to tune the frequency of antenna 204. Electrical connections are provided between the circuit or electrical elements of antenna adapter 206 and antenna 204 as well as with the vehicle radio. By tuning the frequency of antenna 204 (as described further below), a narrow band RF region may be produced where the voltage standing-wave ratio (VSWR) is low so that the cosite performance of antenna 204 may be increased.

Figure 3:
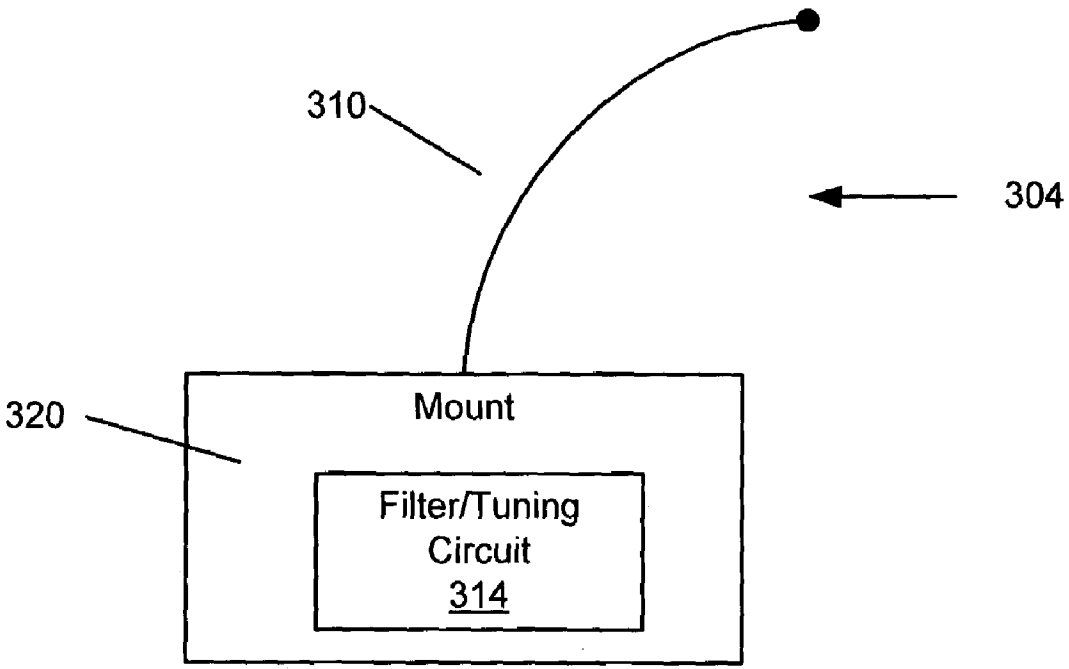
FIG. 3 is a schematic block diagram of an antenna and an antenna adapter in accordance with an alternative embodiment.

In an alternative embodiment, shown in FIG. 3, an antenna 304 may be mounted to a vehicle (not shown) using a mount 320. Mount 320 may be used as an antenna adapter. Mount 320 has a volume defined by a set of dimensions. For example, certain types of military antenna mounts include a space or volume within/inside of the mount. Mount 320 may be configured to include a tunable filter circuit 314 as well as other appropriate circuitry within the volume of the mount itself. The tunable filter circuit 314 is used to tune the frequency of antenna 304. Electrical connections are provided between the circuit or electrical elements of mount 320 and antenna 304 as well as with the vehicle radio. As discussed above, by tuning the frequency of antenna 304 (as described further below), a narrow band RF region may be produced where the voltage standing-wave ratio (VSWR) is low so that the cosite performance of antenna 204 may be increased.

Figure 4:
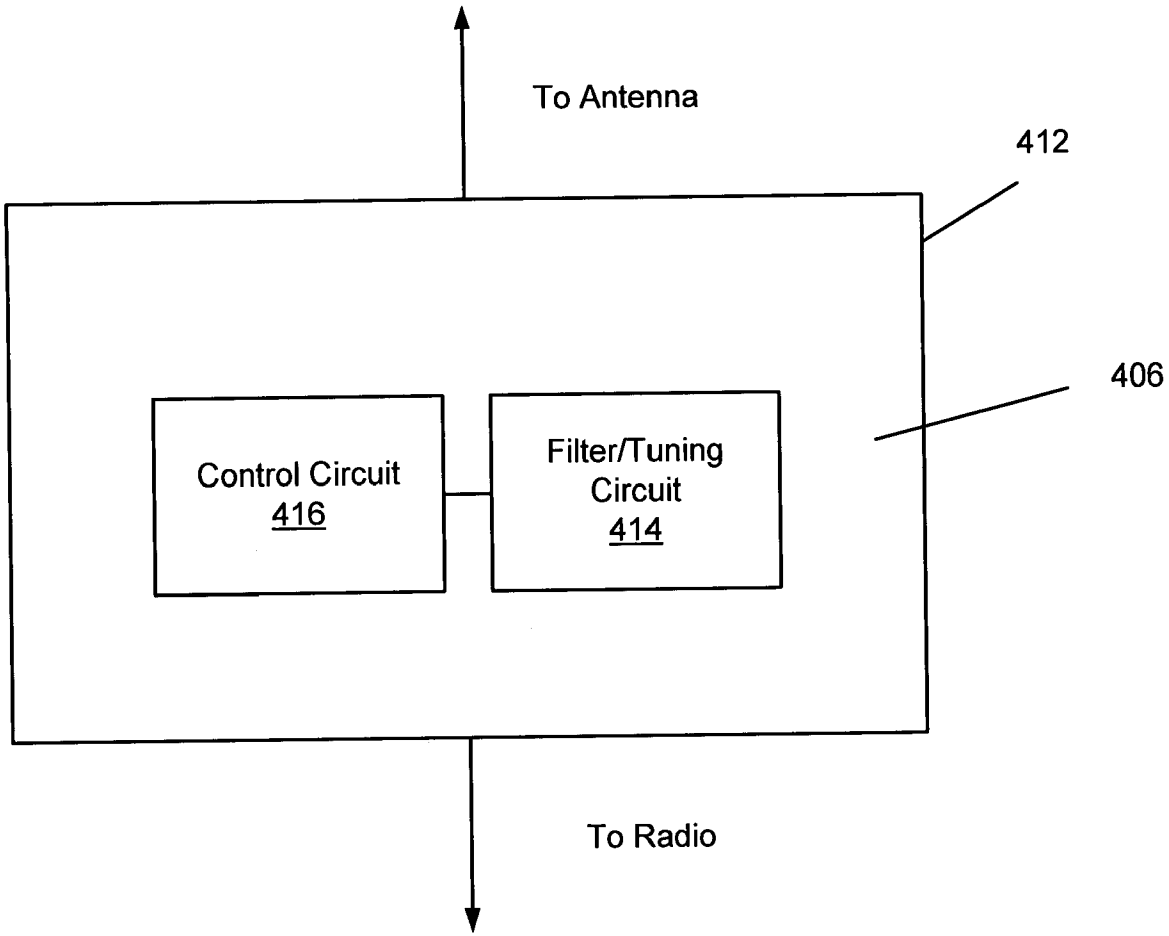
FIG. 4 is a schematic block diagram of an antenna adapter in accordance with an embodiment.

FIG. 4 is a schematic block diagram of an antenna adapter in accordance with an embodiment. Antenna adapter 406 has a housing 412 that may be formed of a metal material. As discussed above, housing 412 preferably has the same dimensions as a base plate (not shown) of the antenna. In an alternative embodiment, as discussed above with respect to FIG. 3, the antenna adapter 406 may be a mount and the tuning components may be contained in the volume of the antenna mount. Antenna adapter 406 also includes a filter/tuning circuit 414 and a control circuit 416. Filter/tuning circuit 414 is configured to tune the antenna (not shown) to a desired frequency for receiving and transmitting signals. Filter/tuning circuit 414 may be a filter or tunable circuit known generally in the art for tuning the frequency of an antenna, such as a "Pi" filter, "L" filters and cavities, etc. The filter/tuning circuit 414 may be selected based on the frequency of operation and the electrical properties of the antennas. In one embodiment, filter/tuning circuit 414 is a frequency agile, high performance filter that is designed to use the whip element of the antenna as part of its bandpass resonant elements.

Control circuit 416 is coupled to filter/tuning circuit 414 and to the vehicle radio. Control circuit 414 is configured to provide control signals to filter/tuning circuit 414 regarding the desired frequency to which to tune the antenna. Control circuit 414 may receive the desired frequency information from the vehicle radio. Control circuit 416 may include various types of control circuitry, digital and/or analog, and may include a microprocessor, microcontroller, application specific integrated circuit (ASIC), or other digital and/or analog circuitry configured to perform various input/output, control, analysis, and other functions described herein.

While the detailed drawings, specific examples and particular formulations given describe preferred and exemplary embodiments, they serve the purpose of illustration only. The inventions disclosed are not limited to the specific forms shown. For example, the methods may be performed in any of a variety of sequence of steps. The hardware and software configurations shown and described may differ depending on the chosen performance characteristics and physical characteristics of the computing devices. For example, the type of computing device, communications bus, or processor used may differ. The systems and methods depicted and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. An antenna adapter for use in an antenna system in a military ground vehicle, the antenna system having an antenna, a radio, and the antenna adapter, the antenna including a whip element, a base plate attached to the whip element and having a first set of dimensions, the antenna adapter attached to the base plate, the antenna adapter comprising:

a housing having a second set of dimensions;

a filter circuit electrically coupled to the whip element and the radio, the filter circuit configured to tune a frequency of the antenna; and wherein the filter circuit is configured to use the whip element as part of a filter circuit bandpass resonant element.

2. The antenna adapter according to claim 1, wherein the second set of dimensions is the same as the first set of dimensions.

3. The antenna adapter according to claim 1, wherein the antenna adapter is mounted to the military ground vehicle.

4. The antenna adapter according to claim 1, wherein the radio is a node in a wireless communication network.

5. The antenna adapter according to claim 4, wherein the wireless communication network is a Joint Tactical Radio System.

6. The antenna adapter according to claim 1, wherein the antenna adapter further comprises a control circuit coupled to the filter circuit and the radio and configured to provide control signals to the filter circuit.

7. The antenna adapter according to claim 1, wherein the filter circuit is configured to produce a band radio frequency region.

8. The antenna adapter according to claim 7, wherein the filter circuit is configured to produce a voltage standing-wave ratio and wherein the voltage standing-wave ratio increases a cosite performance of antenna.

9. An antenna for a military ground vehicle having a radio, the antenna comprising:

a whip element; and an antenna adapter comprising: a mount attached to the whip element, the mount having a volume defined by a set of dimensions; and a filter circuit disposed within the mount volume and electrically coupled to the whip element and the radio, the filter circuit configured to tune a frequency of the antenna;

wherein the filter circuit is configured to use the whip element as part of a filter circuit bandpass resonant element.

10. The antenna according to claim 9, wherein the mount is mounted to the military ground vehicle.

11. The antenna according to claim 9, wherein the radio is a node in a wireless communication network.

12. The antenna according to claim 11, wherein the wireless communication network is a Joint Tactical Radio System.

13. The antenna according to claim 9, further comprising a control circuit coupled to the filter circuit and the radio and configured to provide control signals to the filter circuit.

* * * * *